United States Patent [19]

Lincoln et al.

[11] 4,431,464

[45] Feb. 14, 1984

[54] SALT BATH QUENCHING METHOD AND APPARATUS

[75] Inventors: Joseph A. Lincoln, Milford; William A. Keough, Bloomfield Hills, both of Mich.

[73] Assignee: Atmosphere Furnace Company, Wixom, Mich.

[21] Appl. No.: 304,190

[22] Filed: Sep. 21, 1981

[51] Int. Cl.[3] ..... C21D 1/48

[52] U.S. Cl. ..... 148/15; 148/20; 148/143; 266/44

[58] Field of Search ..... 148/12.4, 15, 15.5, 148/20, 143; 266/44, 120

[56] References Cited

U.S. PATENT DOCUMENTS

| | | | |
|---|---|---|---|
| 2,776,134 | 1/1957 | Wingate | 148/15 |
| 2,851,263 | 9/1958 | Adam | 148/143 |
| 3,372,065 | 3/1968 | Keough | 148/13 R |
| 3,399,877 | 9/1968 | Birjukoua | 148/15 |
| 4,066,477 | 1/1978 | Bockenhoff et al. | 148/15 |
| 4,072,298 | 2/1978 | Kranz | 148/15 |
| 4,109,897 | 8/1978 | Mehrkam | 266/120 |
| 4,113,511 | 9/1978 | Shoemaker | 266/120 |

OTHER PUBLICATIONS

"Metal Process", (Oct. 1953), pp. 122–124.

"American Society for Metals Handbook", (1964), vol. 2, p. 40.

*Primary Examiner*—John P. Sheehan

*Attorney, Agent, or Firm*—Barnes, Kisselle, Raisch, Choate, Whittemore & Hulbert

[57] ABSTRACT

The quench severity of a molten salt bath is drammatically increased by adding substantial amounts of water to the bath while it is being vigorously agitated by two impellors submerged in the bath. One impellor causes an upward flow and the other a downward flow of molten salt which results in a quiescent condition at the surface of the quench zone of the bath.

5 Claims, 8 Drawing Figures

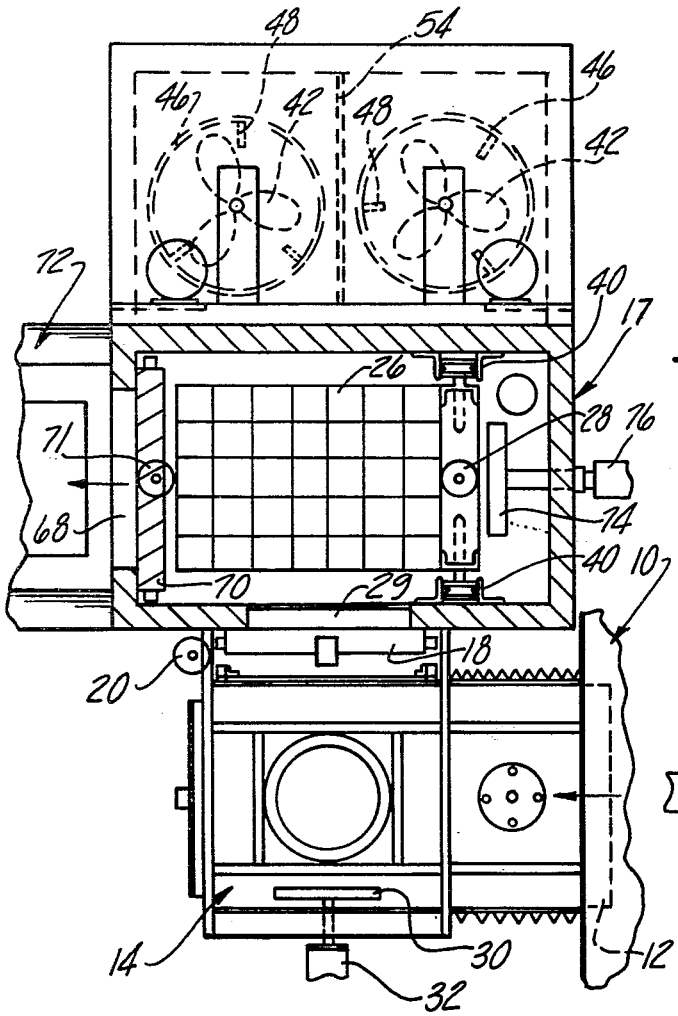
Fig-1
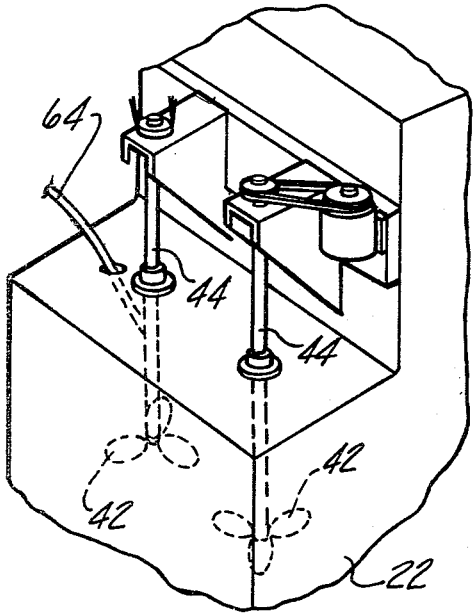
Fig-4
Fig-3
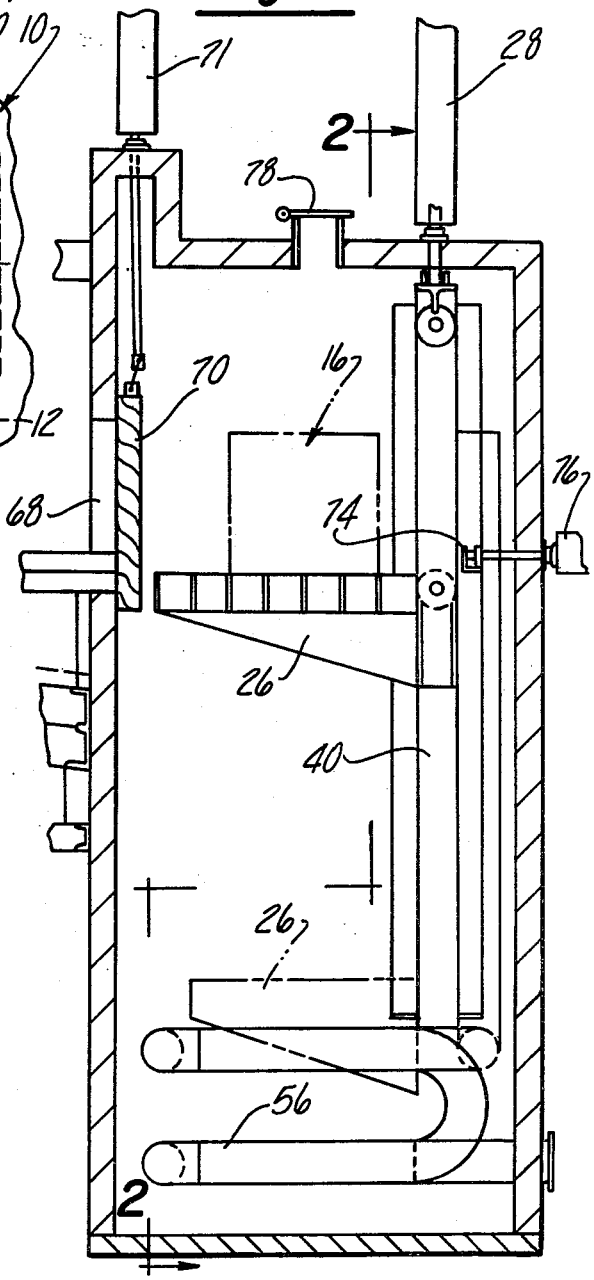

SALT BATH QUENCHING METHOD AND APPARATUS

This invention relates to a heat treating method and apparatus and, more particularly, to a salt bath quenching method and apparatus for hardening ferrous alloys.

In the heat treatment of steel and other ferrous alloys salt baths are sometimes used as the quenching medium. This is particularly true in the case of martempering and austempering where the workpiece is quenched from the austenizing temperature into a molten salt bath at a selected temperature in the upper part of or slightly above the martensite transformation range of the time-temperature transformation (TTT) curve of the alloy. The cooling rate from the austenizing temperature to the quench temperature has to be extremely rapid in the cae of medium and low carbon steels in order to miss the nose of the TTT curve and thereby avoid the formation of ferrite or pearlite. It is known to add water to a salt bath to increase the severity of the quench and to maintain a substantially constant bath temperature; that is, to extract the heat added to the bath by the high temperature of the workpieces quenched in the bath.

The addition of water to a molten salt bath normally presents several problems. One problem involves minimizing vaporization of the water since it is introduced into a bath having a temperature substantially above the boiling point of water. Another problem resides in the prevention of boiling and vaporization of the salt bath itself. A commonly used salt bath, consisting of a ternary mixture of sodium nitrate, potasium nitrate and sodium nitrite, has a boiling point of about 1100° F. and a freezing point of about 290° F. However, the boiling and freezing points of the salt bath are drastically reduced by the addition of water. For example, a water content in the amount of about 6% reduces the boiling point of the salt bath to about 330° F. and the freezing point to about 220° F. However, austempering and martempering normally require quenching of low and medium carbon steels to a temperature in the range of about 360° F. to 600° F. While agitation in a conventional manner tends to decrease the amount of vaporization, nevertheless when the bath temperature is close to its boiling point the heat added by the quenched part causes, at least momentarily, the temperature of the bath to exceed its boiling point. Therefore, even a 3% water content, which lowers the boiling point of the bath to about 385° F., would normally present a vaporization problem in the case of martempering and would be unsuitable for austempering where the temperature of the bath has to be above the martensite formation range, normally at least about 600° F.

We have found that if a salt bath is agitated very vigorously in a manner such as to maintain the surface of the quench zone of the bath in a generally quiescent condition (a gently rolling or swirling motion as distinguished from a turbulent wavy and splashing motion), the water content of the bath can be maintained substantially higher than heretofore deemed practical for autempering and martempering. When agitated in this manner the water-containing bath can be maintained at a temperature substantially above its normal boiling point without boiling and without substantial loss of water by evaporation. Furthermore, I have found that when water is added to a salt bath in amounts of 6% or more per hour and the bath is vigorously agitated in such a manner as to produce a quiescent surface, the severity of the quench can, in many cases, be equal to or exceed that of a water quench without encountering the problems of cracking and distortion associated with water quenching.

Accordingly, the primary object of this invention is to increase the severity of quench obtainable in a molten salt bath by agitating the molten salt vigorously in a manner that maintains its top surface in the quench zone in a quiescent state.

A further object of this invention is to provide an apparatus and method for maintaining a relatively high water content in a molten salt bath into which steel or other ferrous workpieces may be quenched from the austenitic range to obtain a martensitic structure without cracking and with minimum distortion.

A further object of this invention is to provide a method and apparatus for agitating a molten salt bath in a manner that enables the addition of water in amounts of 6% or more per hour without producing excessive vaporization of the water or the salt bath.

Other objects, features and advantages of the present invention will become apparent from the following description and accompanying drawings, in which:

FIG. 1 is a horizontal sectional view of the salt bath quench tank arrangement of the present invention and also showing a portion of a heat treating furnace and a draw furnace used therewith;

FIG. 3 is a vertical sectional view of the quench tank arrangement.

FIG. 4 is a fragmentary perspective view of the agitator arrangement on the quench tank;

Figure 2:
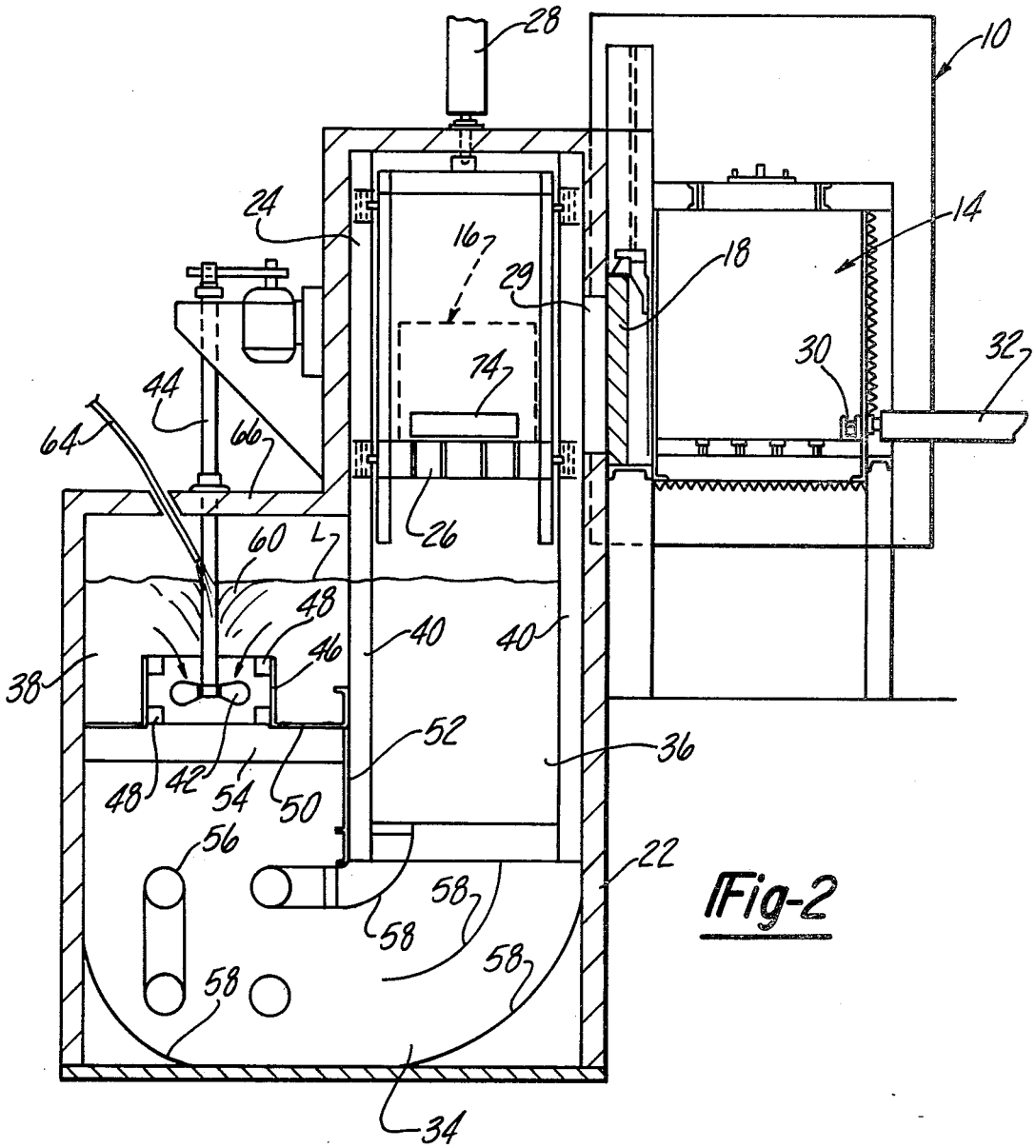
FIG. 2 is a vertical sectional view taken along the line 2—2 in FIG. 3.

FIGS. 1 through 4 illustrate a heat treating arrangement including the apparatus embodying the present invention. A heat treating furnace in which steel or other ferrous workpiece can be heated to the austenizing range is indicated at 10. A door 12 at the discharge end of furnace 10 communicates with a transfer chamber 14 into which the workpieces to be quenched are transferred from the furnace by suitable conveyor means. In the arrangement illustrated the workpieces are heated and quenched while contained in a wire tray 16. Chamber 14 communicates with the quench tank assembly 17 through a door 18 operated by a cylinder 20.

Quench tank assembly 17 is of the type generally known as an elevator type dunker quench. It consists of a housing 22 provided with insulated walls and having an elevator chamber 24 adjacent its upper end. Within chamber 24 there is guided for vertical movement an elevator 26 operated by a cylinder 28. In its uppermost position elevator 26 is aligned with the lower portion of the opening 29 in housing 22 that is controlled by door 18 so that a pusher 30 operated by a cylinder 32 is adapted to transfer the tray 16 containing the heated workpieces from chamber 14 onto elevator 26.

The lower portion of housing 22 forms a quench tank 34 having a quench zone 36 and an agitator zone or chamber 38. The quench tank contains a conventional molten salt bath which fills the tank to the level indicated L in FIG. 2. The vertical rails 40 on which the elevator 26 is guided extend downwardly into the quench zone 36 so that in the lowermost position of the elevator (shown in broken lines in FIG. 3) the workpiece tray 16 is completely submerged in the bath below the top surface thereof.

Within the agitator chamber 38 of tank 34 there is arranged a pair of impellors 42 which are mounted at the lower ends of the motor-driven shafts 44. Each of the impellors 42 is surrounded by a cylindrical shroud 46 having radially inwardly extending anti-cavitation fins 48. Shrouds 46 are arranged side-by-side and have their lower ends mounted on a plate 50 which, except for the circular shroud openings, forms a horizontal dividing wall between upper and lower portions of the agitator chamber 38. The vertically intermediate portion of agitator chamber 38 is separated from the quench zone 36 by a vertically extending wall 52. A short vertical baffle 54 extends downwardly from plate 50 between the two shrouds 46.

The two impellors 42 are operated such that one of the impellors circulates the molten salt in a direction downwardly through the surrounding shroud and the other circulates the molten salt in a direction upwardly through its surrounding shroud. This can be accomplished by rotating the motor-driven shafts 44 in opposite directions or by having the pitch of one of the impellors opposite to the pitch of the other impellor. With this arrangement, when the impellors are rotated substantially all the molten salt is constrained to flow through shrouds 46 and circulate between quenching zone 36 and agitator chamber 38.

Gas-fired heating tubes 56 are arranged in the lower end of tank 34 to supply heat to the molten salt bath as required. The supply of hot gas to tubes 56 is thermostatically controlled to maintain the desired operating temperature of the bath. There is also arranged at the lower portion of tank 34 a plurality of arcuate baffles 58 for promoting the circulation of the molten salt between the quench zone 36 and the agitation zone 38.

The two impellors 42 are rotated at a speed such that the impellor which is directing the molten salt downwardly through its shroud 46 creates a vortex 60 at the surface of the salt bath surrounding its motor-driven shaft 44. A water supply tube 64 extends through the wall 66 overlying the agitator zone 38 and has its discharge end located adjacent shaft 44 just above the surface L of the salt bath. The water discharged from tube 64 impinges against shaft 44 at about the level of the salt bath.

The elevator chamber 24 preferably has a second opening 68 therein controlled by a door 70 which communicates with a draw furnace 72. Door 70 is raised and lowered by a cylinder 71. After a load of workpieces is quenched and the elevator raised to its uppermost position shown in FIG. 2, a pusher 74 may be operated by a cylinder 76 to displace the loaded tray 16 from elevator 26 into the draw furnace 72. When the workpieces are quenched, a considerable amount of vapor is generated. Accordingly, the upper end of elevator chamber 24 is provided with a pressure release cap 78.

In a typical installation tank 34 has outside dimensions of about 6 feet by 7 feet, 8 inches, the walls thereof having about 4 inches of insulation thereon. The salt bath has a depth of about 6 feet, 6 inches so that it has a volume of about 1600 gallons and weighs about 26,000 pounds. Agitator chamber 38 has a width of about 3 feet, 8 inches and quench zone 36 has a width of about 3 feet, 4 inches. Vertical wall 52 is about 40 inches high and has its upper edge disposed below the salt level L about 8 inches. Plate 50 is located about 2 feet below the surface of the bath. Vertical baffle 54 has a height of about 6 inches and shrouds 46 are about 12 inches high and 21 inches in diameter. Impellors 42 are of the three blade type having a diameter of 18 inches and a pitch of 18 inches.

With the arrangement described above, when impellors 42 are rotated at about 550 r.p.m. all of the salt in the tank is caused to flow through either one or the other of the two impellors at the rate of about 8 times per minute. At this speed the velocity of flow at the workpieces in the submerged basket is about 3 feet per second. Stated differently, when impellors 42 are rotating at about 550 r.p.m. substantially all of the 1600 gallons of molten salt is recirculated in the tank between quench zone 36 and agitator zone 38 about 8 times per minute and is therefore being agitated very vigorously. Surprising as it may seem, when the impellors are operating at this speed the surface of the salt bath in the quench zone is in a quiescent condition; it has a gently rolling or swirling motion as distinquished from a turbulent, wavy and splashing motion. This is true even when water is added to the bath through tube 64 at a rate of 12% or higher by weight of the salt bath per hour. It is believed that the quiescent condition at the surface of the salt bath accounts for the fact that during a quench at least about half of the water added to the bath is retained therein rather than escaping as vapor even though the temperature of the bath is substantially higher than the boiling point of the water. This is evidenced by the fact that, if rotation of either or both of the impellors 42 is arrested, the bath immediately begins to boil, the surface thereof becomes very turbulent and a large amount of vapor is generated.

In the above described installation, when the impellors 42 are rotated at a speed above about 550 r.p.m., cavitation and surging occurs. The surface of the bath is no longer quiescent and the unique hardening results hereinafter described are not obtained. Likewise, if the impellors 42 are rotated at a speed less than about 275 r.p.m. so that the velocity flow at the load is less than about 1½ feet per second, the bath is not sufficiently agitated and the unique results are not obtained.

The following examples are indicative of the severity of quench obtainable when the apparatus is operated in the manner described.

EXAMPLE 1

A load of 2" diameter balls of modified SAE 1070 steel was quenched from 1600° F. into the salt bath at 360° F. while water was being added at the rate of 12% by weight of the salt bath per hour. The steel had the following composition: C 0.72%, Mn 1.12%, SI 0.26%, Cr 0.47% and Mo 0.08%. The total weight of the load (both the balls and the tray) was about 370 pounds of steel. Impellors 42 were rotated at a speed of about 550 r.p.m. The load was held in the bath for about two minutes and then air cooled. The microstructure of the quenched steel balls was martensitic throughout. This indicates that the entire load cooled to a temperature of below 900° F. (the nose of the TTT curve) in less than 2 seconds.

Figure 5:
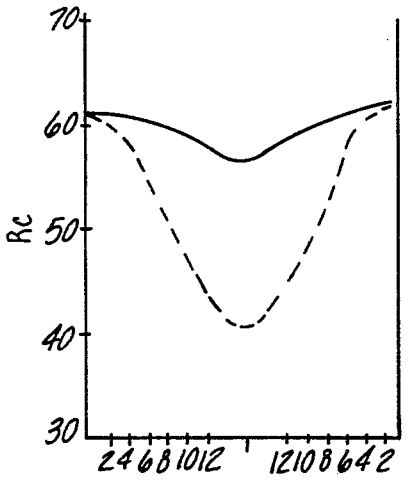
FIGS. 5, 6 and 7 are hardness profile curves showing the results of various tests in accordance with the present invention.

In FIG. 5 the solid line indicates the hardness profile obtained across a diametrical section of the balls. The surface hardness was 62 Rc and at the center a hardness of 57 Rc was obtained. The profile of this hardness curve shown in FIG. 5 clearly illustrates the fact that the hardness obtained at the center is substantially higher than would have been obtained if the balls had been quenched in water. The hardness profile that would have been produced by a water quench is illustrated by a broken line in FIG. 5 and represents the Jominy hardness calculated by the Grossman technique as described at pages 18 and 19 of Volume 2 of the "ASM Metals Handbook", 1964 Edition. The hardness profile actually obtained is about the same as would have been obtained if the balls had been quenched in brine. However, a brine quench would have resulted in the balls cracking. Accordingly, the results show that the salt bath quench was substantially more severe than a water quench (actually a quench comparable to a brine quench), but did not result in the distortion and cracks that would have resulted from a brine quench. The Grossman chart at page 19 of the above-mentioned text indicates that a hot salt bath quench has a severity of substantially less than water or brine. Based on the Grossman chart one would expect that the hot salt quench would have produced pearlite rather than martensite. It, therefore, follows that the water content of the salt bath, about 6% in this case, accounts for the fact that heat was removed from the steel at a rate faster than a water quench and at about the same rate as a brine quench. It should also be noted, however, that the bath temperature was substantially higher than the boiling point of water and also higher than the boiling point of a quiescent salt bath containing 6% water.

The results obtained cannot be attributable merely to the fact that the rate of heat extraction results solely from the evaporation of the water in the bath. Since, as pointed out above, the load must be cooled from 1600° F. down to at least 900° F. in less than two seconds, heat was extracted from the load at the rate of 25,900 btu's per second or 93,240,000 btu's per hour. This is many times greater than the heat required to vaporize the water added to the bath in one hour. It, therefore, follows that with a relatively high water concentration in the salt bath, the rate of heat extraction from the workpieces being quenched must result from some phenomenon other than the mere vaporization of the water in the bath.

EXAMPLE 2

Figure 6:
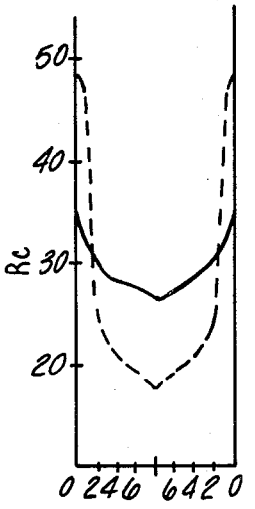

A load of about 480 pounds of 1 inch round steel bars having a length of 4 inches was quenched from 1600° F. into the salt bath at 380° F. The steel was SAE 1038 having a carbon content of 0.412% and manganese 0.80%. The impellors were rotated at 550 r.p.m. and water was added to maintain water content of the bath at about 6%. The hardness profile of the bars after quenching is indicated by the solid line in FIG. 6. The hardness profile of a water quench of these bars is shown by the broken line in FIG. 6. These profiles show that the rate at which heat was extracted from the bars was less than a water quench at the surface of the bars, but substantially greater than a water quench at the center of the bars. This clearly indicates that when quenched in a salt bath in accordance with the present invention the thermal gradient through the cross section of the bars is less than occurs with a water quench. As a result, the tendency for the workpiece to distort or crack is considerably lessened when quenched in this manner as compared with a water quench.

EXAMPLE 3

Figure 8:
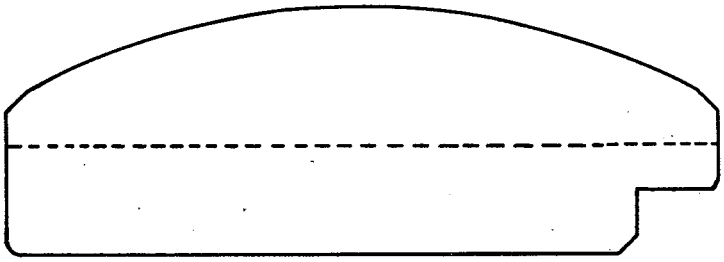
FIG. 8 is a cross section of a workpiece quenched in accordance with one of the tests described.
Figure 7:
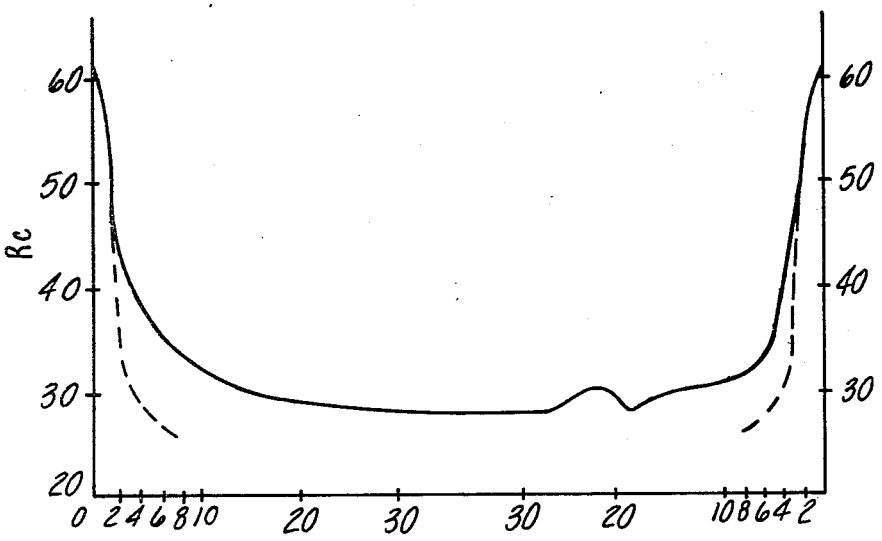

A load of SAE 1050 steel parts having the shape shown in FIG. 8 was austenized two hours at 1750° F. and then quenched and held for about two minutes in a salt bath at 360° F. The workpieces had a diameter of 4½ inches, a thickness of about ⅞ inch at the edge and a thickness at the center of 1½ inches. The impellors were rotated at about 550 r.p.m. and water was added to the salt bath at the rate of about 12% by weight per hour. The hardness profile for the cross section across the diameter of the part is shown by the solid line in FIG. 7. The standard Jominy hardness curve for this part is shown by the broken line in FIG. 7. These curves illustrate that at the surface of the part the severity of the quench was equal to that of a water quench and that at a very short distance from the outer surface of the part the severity of the quench was substantially greater than that of a water quench. The parts did not crack and were not distorted as would be the case if these parts had been quenched in water.

In each of the above examples the salt bath was the conventional ternary mixture of sodium nitrate, sodium nitrite and potassium nitrate.

Each of the above examples were directed to quenching to obtain a martensitic structure at least at the surface of the workpiece and, by necessity, the salt bath was maintained at a temperature within the martensite formation range of the alloy; that is, at a temperature below that which martensite will begin to form upon cooling. For austempering the same salt bath operated in the same manner and with water addition at the rate of 6% per hour or greater can be maintained at a temperature slightly above the martensite formation range so as to obtain a bainite microstructure with steels of normally low hardenability; that is, steels which are normally considered impractical for austempering.

For example, the SAE 1038 steel of Example 2 cannot be austempered by conventional methods in any size and the SAE 1050 steel of Example 3 cannot be austempered by conventional methods in a cross section greater than about 1/16 inch. With the salt bath of the present invention operated in the manner described above the steel of Example 2 can be austempered in a salt bath containing about 6% water when quenched to a temperature of about 700° F. Likewise, an SAE 1050 steel having a cross section of about 1½ inch can be austempered by quenching from about 1600° F. to about 550° F. in the salt bath when operated as above described and containing about 2% to 4% water.

It is believed that the unique results obtained are attributable, at least in part, to the fact that the salt bath is vigorously agitated in a manner which results in a quiescent surface condition. The water continuously added to the bath at a relatively high rate at the vortex of the downwardly flowing molten salt is immediately entrained in the bath and is prevented from having any substantial residence time at the surface of the bath. This accounts for the ability to maintain the bath at a relatively high water content, substantially above 3% if desired, without substantial evaporation. The quiescent surface of the bath, even though it is agitated vigorously, results from the balanced counterflow of the impellors.

With the present invention a very wide latitude of quench severity in the salt bath can be obtained by simply varying the water content of the bath over a relatively wide range. Present practice requires utilization of an oil quench in the case of one workpiece or a water or brine quench in the case of other workpieces. With the present invention the rate of water addition is determined by the quench severity desired. Sufficient water is added to the bath so that the rate of cooling is such as to miss the nose of the TTT curve. A relatively high water content (for example, 6%) is required in the case of low carbon steels and also in the case of workpieces of large cross section when it is desired to obtain a high hardness inwardly from the surface. On the other hand, a water content as low as 3% is suitable in the case of medium carbon steels of relatively light section. Normally water should be continuously added to the bath at a rate equivalent to at least about twice the desired water content of the bath.

Furthermore, with the present invention higher and more uniform hardness properties are obtainable in plain carbon steels than have heretofore been obtained. In the past such properties have required the use of alloys such as molybdenum, chromium and nickel which shift the nose of the TTT curve to the right. With the present invention the rate of heat extraction is sufficiently rapid to avoid the nose of the TTT curve even with plain and low carbon steels.

We claim:

1. The method of hardening a workpiece by quenching it in a molten salt bath which is divided into a quench zone and an agitation zone by a generally vertically extending wall having its lower edge spaced above the bottom of the bath and its upper edge spaced below the top of the bath which comprises adding water to the bath in an amount to maintain a water content in the bath of at least 3% by weight and a bath temperature of between 350° F. and 700° F.; preventing boiling of the bath and excessive vaporization of the water while simultaneously causing the surface of the bath at the quench zone to assume a quiescent condition by rapidly recirculating the molten salt between said zones around the upper and lower edges of said wall, said recirculation being effected by vigorously agitating the salt in the agitation zone by means of two impellors in the agitation zone rotated to produce in said agitation zone two vertically opposite, high velocity paths of molten salt, said impellors being rotated at a speed to produce a velocity of molten salt at the surface of a workpiece in the quench zone of between about $1\frac{1}{2}$ to 3 feet per second, said water being added to said agitation zone as a downwardly directed stream aligned generally vertically with the downwardly directed, high velocity flow path in said agitation zone and simultaneously quenching the workpiece in the quench zone.

2. The method called for in claim 1 wherein the bath is maintained at a temperature of above 350° F. and the water is added to maintain the water content of the bath at about 6%.

3. The method called for in claim 1 wherein the agitation zone is divided in its entirety by a horizontal partition into upper and lower chambers which communicate through said impellors, one of said chambers being on the upstream side and the other on the downstream side of said impellors so that all of the molten salt is constrained to flow through said impellors as it circulates between said quench and agitation zones.

4. The method called for in claim 1 wherein said vertical wall extends laterally across the full extent of the salt bath so that the salt is recirculated between opposite ends of the bath.

5. The method called for in claim 1 wherein the workpiece is a ferrous alloy and the bath is maintained at a temperature within or slightly above the martensite transformation range of the alloy.

* * * * *